US012022890B2

(12) United States Patent
Barnard

(10) Patent No.: US 12,022,890 B2
(45) Date of Patent: Jul. 2, 2024

(54) SWADDLE DEVICE AND METHOD

(71) Applicant: Jennifer Barnard, Plano, TX (US)

(72) Inventor: Jennifer Barnard, Plano, TX (US)

( * ) Notice: Subject to any disclaimer, the term of this patent is extended or adjusted under 35 U.S.C. 154(b) by 0 days.

(21) Appl. No.: 17/833,192

(22) Filed: Jun. 6, 2022

(65) Prior Publication Data

US 2023/0389620 A1 Dec. 7, 2023

(51) Int. Cl.
*A41B 13/06* (2006.01)

(52) U.S. Cl.
CPC ..... *A41B 13/06* (2013.01); *A41B 13/065* (2013.01); *A41B 2300/32* (2013.01)

(58) Field of Classification Search
CPC .... A41B 13/06; A41B 13/065; A47G 9/1045; A47G 9/0238; A47K 10/00; A61F 5/56; A47D 15/003
See application file for complete search history.

(56) References Cited

U.S. PATENT DOCUMENTS 2,491,855 A * 12/1949 Gainor ..... A41B 13/06 128/873
3,485,241 A * 12/1969 Robert ..... A41D 10/00 2/69.5
3,739,399 A * 6/1973 Sheahon ..... A41D 13/1272 2/69.5
4,759,082 A * 7/1988 Mulligan ..... A41D 15/04 2/69.5
4,897,885 A * 2/1990 Lunt ..... A41B 13/06 2/70
5,022,107 A * 6/1991 Knotts ..... A47C 4/52 5/419
5,210,891 A * 5/1993 Avital ..... A45F 4/06 5/419
5,297,304 A * 3/1994 O'Sullivan ..... A47C 7/46 5/636
5,341,531 A * 8/1994 Straub ..... A47D 15/008 5/655
5,347,669 A * 9/1994 Neviaser ..... A47D 15/008 5/655
5,418,979 A * 5/1995 Senderowicz ..... A41B 13/06 2/69
5,722,094 A * 3/1998 Ruefer ..... A41B 13/06 2/69.5
5,920,933 A * 7/1999 Chou ..... A47G 9/10 5/636

(Continued)

*Primary Examiner* — Heather Mangine
(74) *Attorney, Agent, or Firm* — Kutak Rock LLP; Ryan S. Hinderliter

(57) ABSTRACT

A swaddle device and method for treating and/or preventing plagiocephaly. The swaddle device includes a fabric garment having an internal cavity configured for housing a positioning support device, one or more wrap layers, and a lower pouch flap. In an embodiment, the swaddle device comprises an inner wrap layer and an outer wrap layer, and the internal cavity and positioning device comprise an internal pocket and a bolster, respectively. In an embodiment, a baby is positioned on the open swaddle device with the positioning support device in relation to the baby's body in a desired position; the inner wrap layer is tightly wrapped around the baby's upper body; the lower pouch flap is wrapped around the baby's legs and lower torso; and the outer wrap layer is tightly wrapped around the baby, positioning support device, inner wrap layer, and lower pouch flap.

11 Claims, 8 Drawing Sheets

(56) References Cited

U.S. PATENT DOCUMENTS 5,937,461 A * 8/1999 Dombrowski ..... A47D 15/008 5/655
5,950,261 A * 9/1999 Hay ..... A41B 13/06 5/655
6,009,576 A * 1/2000 Gramme ..... A41B 13/06 5/413 R
6,061,849 A * 5/2000 Seals ..... A47G 9/062 5/656
6,141,805 A * 11/2000 Fisher-Cohen ..... A47D 15/003 5/413 R
6,223,367 B1 * 5/2001 French ..... A47G 9/0207 5/419
6,327,726 B1 * 12/2001 Weber ..... A47D 5/006 5/118
6,341,397 B1 * 1/2002 Kliegl ..... A41B 13/06 2/69.5
6,591,426 B1 * 7/2003 Smith ..... A47G 9/086 2/69.5
6,662,390 B1 * 12/2003 Berger ..... A41B 13/06 5/655
6,868,566 B2 * 3/2005 Gatten ..... A41B 13/06 5/413 R
7,621,005 B1 * 11/2009 Harvey ..... A45C 11/20 5/503.1
7,752,692 B1 * 7/2010 Sanders ..... A47D 5/006 5/655
8,302,225 B1 * 11/2012 Earnest ..... A41B 13/06 5/413 R
8,650,685 B1 * 2/2014 Ford ..... A41B 13/06 5/655
9,107,519 B2 * 8/2015 Clark ..... A47G 9/06
D741,568 S * 10/2015 Daugherty ..... D2/719
9,332,791 B1 * 5/2016 Bush ..... A47D 15/003
9,332,858 B1 * 5/2016 Chiang ..... A47C 7/62
9,380,896 B2 * 7/2016 Carangelo ..... A47G 9/1045
10,463,168 B2 11/2019 Karp et al.
10,624,456 B2 * 4/2020 Fernandez ..... A47C 7/021
11,109,689 B1 * 9/2021 Heisey ..... A47D 15/003
D936,931 S * 11/2021 Parker ..... D2/719
11,344,396 B2 * 5/2022 Levine ..... A01K 15/04
11,647,848 B1 * 5/2023 Coates ..... A41B 13/06 5/494
2005/0034239 A1 * 2/2005 Mann ..... A47D 15/003 5/660
2005/0102757 A1 * 5/2005 Lee ..... A47G 9/10 5/636
2005/0204471 A1 * 9/2005 Ruiz ..... A47D 5/006 5/655
2006/0185055 A1 * 8/2006 DeWitt ..... A41B 13/08 2/111
2006/0282953 A1 * 12/2006 Telegadis ..... A47D 15/003 5/655
2007/0157382 A1 * 7/2007 Reeves ..... A47G 9/0246 5/482
2009/0007337 A1 * 1/2009 Mese ..... A47D 15/003 5/655
2009/0056017 A1 * 3/2009 Jones ..... A47G 9/02 5/485
2009/0178204 A1 * 7/2009 Sager ..... A47D 5/006 5/655
2010/0218314 A1 * 9/2010 Mulheron ..... A47G 9/068 5/494
2010/0257653 A1 * 10/2010 Pitts ..... A41B 13/06 2/69.5
2010/0275373 A1 * 11/2010 Kaplan ..... A41B 13/06 5/494
2011/0099719 A1 * 5/2011 Hardesty ..... A47D 13/08 5/655
2011/0162660 A1 * 7/2011 Sanger ..... A61F 5/05891 2/255
2011/0231993 A1 * 9/2011 Schmid ..... A41B 13/06 2/69.5
2012/0023637 A1 * 2/2012 Neveu ..... A41B 13/06 2/69.5
2013/0104279 A1 * 5/2013 Galli, Jr. ..... A41D 13/1272 2/69
2013/0283527 A1 * 10/2013 Houston ..... A41B 13/06 5/494
2013/0333113 A1 * 12/2013 Gotel ..... A41B 13/06 5/494
2014/0020177 A1 * 1/2014 Coates ..... A41B 13/06 5/494
2014/0033430 A1 * 2/2014 Daugherty ..... A41B 13/06 5/494
2014/0041123 A1 * 2/2014 North ..... A47G 9/10 5/632
2014/0165257 A1 * 6/2014 Wynh ..... A41B 13/06 2/69.5
2014/0196214 A1 * 7/2014 DuPre ..... A47G 9/1081 5/636
2014/0298587 A1 * 10/2014 Sedivy ..... A41D 11/00 5/655
2015/0128350 A1 * 5/2015 Paperno ..... A41B 13/06 5/655
2015/0265452 A1 * 9/2015 DeSantis ..... A61F 5/37 128/871
2016/0278443 A1 * 9/2016 Clements ..... A41B 13/065
2016/0295928 A1 * 10/2016 Bopanna ..... A41B 13/06
2017/0055592 A1 * 3/2017 Stephan ..... A41B 13/06
2017/0181478 A1 * 6/2017 O'Donnell ..... A45C 13/30
2017/0311663 A1 * 11/2017 Wollschlaeger ..... A41D 15/00
2018/0070652 A1 * 3/2018 Geraghty ..... A41D 13/1281
2019/0223517 A1 * 7/2019 Collins ..... A41D 13/1272
2019/0297954 A1 * 10/2019 Damir ..... A47G 9/083
2019/0313702 A1 * 10/2019 Karp ..... A41B 13/065
2020/0146475 A1 * 5/2020 Sherry ..... A47G 9/1027
2021/0030076 A1 * 2/2021 Lee ..... A41B 13/065
2021/0059319 A1 * 3/2021 Karp ..... A41B 13/065
2021/0076852 A1 * 3/2021 Petersen ..... A61G 7/0755
2021/0274870 A1 * 9/2021 Hurd ..... A47G 9/066
2022/0053838 A1 * 2/2022 Scott, Jr. ..... A41B 13/065
2022/0117319 A1 * 4/2022 Peters ..... A47G 9/083
2022/0304406 A1 * 9/2022 Cady ..... A41D 13/1272
2022/0338557 A1 * 10/2022 Coates ..... A41B 13/06
2023/0210281 A1 * 7/2023 Raines ..... A47C 31/11 5/482
2023/0389620 A1 * 12/2023 Barnard ..... A41B 13/06

* cited by examiner

SWADDLE DEVICE AND METHOD

FIELD OF THE INVENTION

The present invention relates generally to infant care and treatment devices. More specifically, the present invention is concerned with a swaddle device and method for positioning an infant to help prevent and/or correct plagiocephaly.

BACKGROUND OF THE INVENTION

Plagiocephaly, commonly referred to as infant flat head syndrome, affects nearly half of newborns each year. Plagiocephaly is often an unwanted complication from newborns and infants sleeping in supine position, or on one's back with torso and head facing in the same direction for long periods of time. Supine sleeping is strongly advocated for by pediatric healthcare professionals, including but not limited to the American Academy of Pediatrics (AAP), for infant safety and to lower the risk of sudden infant death syndrome (SIDS). Nevertheless, at birth and for approximately six to nine months following birth, babies' skulls are very malleable and thus are susceptible to forces applied thereto as they continue to develop. Newborn babies typically sleep 15-17 hours a day, so with the combination of developing skull malleability and extensive sleep time, it is quite common for the back of an infant's skull to become misshapen, often within two months, if the infant sleeps in the same position every day. Plagiocephaly deformities range from mild to severe, but such deformities are preventable and treatable. Accordingly, it would be beneficial to have a device and method for preventing and treating plagiocephaly while still accommodating safe supine sleeping.

Commonly used products for preventing plagiocephaly include head or "plagio" pillows, however these products have their disadvantages. For instance, such devices limit movement of the infant's head and neck when worn, which can actually result in more head flattening and/or torticollis, which is neck tightness often requiring physical therapy. Moreover, there are significant safety concerns associated with devices such as head pillows because they can get dislodged and become suffocation hazards. Furthermore, such devices do not truly unweight the head but rather merely keep the head in one position. Typically, these devices are not adjustable and do not fit every baby properly.

Cranial helmets or orthoses are another common way to correct plagiocephaly, but these are quite costly and not feasible for many families. Additionally, these helmets or orthoses are cumbersome and uncomfortable for the baby and usually must be worn up to 23 hours per day for several months. Accordingly, it would be beneficial to have a device and method for treating plagiocephaly which truly unweights the baby's head, allows for continued movement of the baby's head and neck, is not a suffocation hazard, is easily adaptable to babies of different sizes, is comfortable for the baby, and is cost effective.

Swaddling, or wrapping a baby snugly in a blanket or fabric, is a commonly used method to help to calm a baby and to promote better, more restful sleep. Swaddling calms babies because the tight wrapping simulates the womb. Moreover, swaddling helps prevent the newborn startle reflex from waking the baby by wrapping the baby's arms tightly next to the baby's sides. There are not currently available devices which incorporate swaddling for safe and sound sleep while also simultaneously comfortably positioning a baby in a desired position to prevent the skull from flattening. Accordingly, it would be beneficial to have a device which closely wraps around a baby and is configured for preventing and/or correcting infant flat head syndrome.

Heretofore there has not been available a swaddle device or method for treating plagiocephaly with the advantages and features of the present invention.

SUMMARY OF THE INVENTION

The present invention comprises a swaddle device and method for treating plagiocephaly. The swaddle device comprises a fabric garment having an internal bolster pocket, an inner wrap layer, a lower pouch flap, an outer wrap layer, and a bolster. In an exemplary embodiment of the present invention, the internal bolster pocket is configured to receive and hold the bolster within the swaddle garment. In alternative embodiments, corrective support device(s) other than a bolster are utilized.

In an exemplary embodiment of the present invention, the inner wrap layer is comprised of first and second fabric extensions configured for being wrapped tightly around a baby's upper body with the bolster positioned in a desired location in relation to the baby and for being fastened to each other. The lower pouch flap, in this embodiment, forms a fabric sack open at its proximal end and enclosed at its distal end. The lower pouch flap is configured to receive and enclose the legs and lower torso of a baby. In a preferred embodiment, the lower pouch flap is configured for being fastened to the inner wrap layer. In an exemplary embodiment, the outer wrap layer is comprised of first and second fabric extensions configured for being wrapped tightly around the baby, the inner wrap layer, and a portion of the lower pouch flap and for being fastened to each other. In embodiments, the inner wrap layer, outer wrap layer, internal bolster pocket, and lower pouch flap are sewn to or otherwise affixed to each other, either directly or indirectly.

In an exemplary embodiment, a bolster is placed and enclosed within the internal bolster pocket of the swaddle device, and a baby is positioned on the garment in relation to the bolster in such a way to unweight the baby's head as desired to treat plagiocephaly, with the swaddle device lower pouch flap positioned downward, or inferior, toward the baby's feet, and with the inner and outer wrap layers open. With the baby positioned in desired relation to the bolster, the inner wrap layer first and second fabric extensions are wrapped snugly around the baby's torso, and the inner wrap first and second extensions are secured to each other, putting the inner wrap layer into closed position. The lower pouch flap is loosely placed around the baby's legs and lower torso and secured to the inner wrap layer. In this embodiment, the outer wrap first and second fabric extensions are wrapped snugly around the baby, bolster, inner wrap layer, and a portion of the lower pouch flap and secured to one another. Such configuration of the swaddle device of the present invention provides calming, deep pressure to a baby's upper extremities along with secure positioning of a bolster to keep the baby from laying on a particular portion of the baby's head, accommodating unweighing of the head to counteract plagiocephaly.

In embodiments, the present invention comprises a swaddle device and method of preventing and treating plagiocephaly in babies which accommodates safe, supine sleeping.

In embodiments, the present invention comprises a swaddle device and method of preventing and treating plagiocephaly which unweights a baby's head while allowing continued movement of the baby's head and neck.

In embodiments, the present invention comprises a swaddle device and method of preventing and treating plagiocephaly which is not a suffocation hazard for babies.

In embodiments, the present invention comprises a swaddle device and method of preventing and treating plagiocephaly which is easily adaptable to babies of different sizes.

In embodiments, the present invention comprises a swaddle device and method of preventing and treating plagiocephaly which is simple, easy to use, and cost effective for users.

In embodiments, the present invention comprises a swaddle device and method of preventing and treating plagiocephaly which also promotes better sleep by simulating the womb and calming the baby.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

Embodiments of the present invention are described in detail below with reference to the attached drawing figures, wherein.

Figure 1:
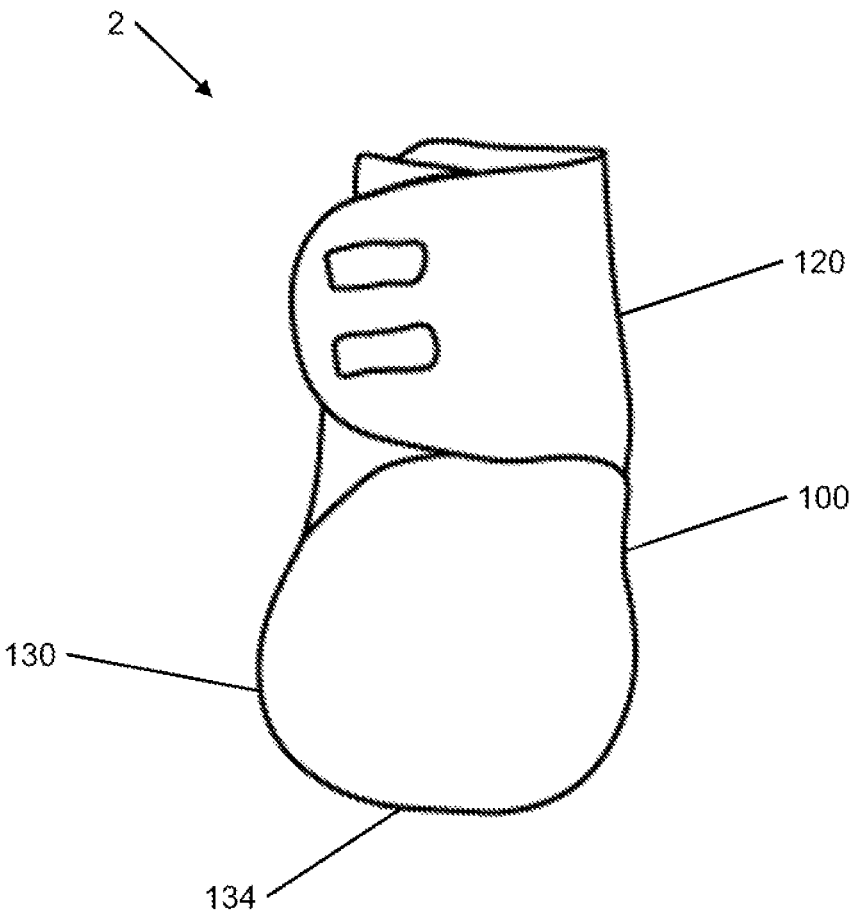
FIG. 1 shows a top, plan view of a swaddle device embodying the present invention in a closed configuration.

The drawing figures do not limit the present invention to the specific embodiments disclosed and described herein. The drawings are not necessarily to scale, emphasis instead being placed upon illustrating the principles of the invention.

DETAILED DESCRIPTION OF THE PREFERRED EMBODIMENTS

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention discloses a swaddle device 2 and method. In an exemplary embodiment, the swaddle device 2 is utilized to treat and/or prevent plagiocephaly, also known as infant flat head syndrome, by positioning a baby to unweight a portion of the baby's head. In an exemplary embodiment, the swaddle device 2 of the present invention comprises a fabric garment 100 having an internal cavity 140 configured for housing a positioning support device 200, one or more wrap layers 110, 120, and a lower pouch flap 130. In an exemplary embodiment, the fabric garment 100 of the present invention is made up of a breathable fabric such as but not limited to cotton, muslin, or bamboo. In other embodiments, the fabric garment 100 is made up of any other type of fabric without deviating from the present invention.

Now referring to FIGS. 1-8, in a preferred embodiment, the swaddle device fabric garment 100 comprises an inner wrap layer 110 and an outer wrap layer 120. In alternative embodiments, the garment of the present invention includes one wrap layer, three wrap layers, four wrap layers, or any other number of wrap layers. As shown in FIGS. 1-4, each wrap layer 110, 120 is comprised of first 112, 122 and second fabric extensions 114, 124 which extend outward laterally from a center portion of the garment 100 in an open position. In a preferred embodiment, the first 112, 122 and second fabric extensions 114, 124 are configured for being wrapped around a baby 300 with at least a portion of the first 112, 122 and second fabric extensions 114, 124 overlapping and the first 112, 122 and second fabric extensions 114, 124 secured to one another, resulting in a closed position of the respective wrap layer. In an exemplary embodiment, the wrap layers 110, 120 further include fasteners 116 for fastening the fabric extensions to each other. In an exemplary embodiment, the fasteners 116 comprise hook-and-loop fasteners. In other embodiments, the fasteners 116 comprise snap-in connectors, magnetic connectors, zippers, buckles, or any other type of releasable connectors. Preferably, the present invention includes multiple fastener positions and/or extended fastener sections to accommodate tight wrapping for babies of different sizes. In a further embodiment of the present invention, the wrap layers 110, 120 do not include fasteners and are instead configured for being secured by tucking one fabric extension into another fabric extension.

In an exemplary embodiment, as shown in FIGS. 1-5, a lower pouch flap 130 comprises a fabric sack having an open proximal end 132 and an enclosed distal end 134. The lower pouch flap 130 is configured for receiving and enclosing a baby's legs and lower torso. Preferably, the lower pouch flap 130 of the present invention is sized to loosely fit around a baby's legs and lower torso. In an exemplary embodiment, the lower pouch flap 130 is configured for being secured to the inner wrap layer 110. In alternative embodiments, the lower pouch flap 130 is configured for being secured to the outer wrap layer 120. In embodiments, the lower pouch flap 130 includes fasteners 116 configured for engagement with fasteners 116 on a wrap layer. In embodiments, such fasteners 116 comprise hook-and-loop fasteners, snap-in connectors, magnetic connectors, zippers, buckles, or any other type of releasable connectors. In an exemplary embodiment, the lower pouch flap 130 and/or corresponding wrap layer to be engaged include(s) multiple fastener positions and/or extended fastener sections to accommodate wrapping with babies of different sizes. In further embodiments, the lower pouch flap 130 does not include fasteners and is instead configured for being secured by tucking a portion of the lower pouch flap 130 into one or more wrap layer.

Figure 2:
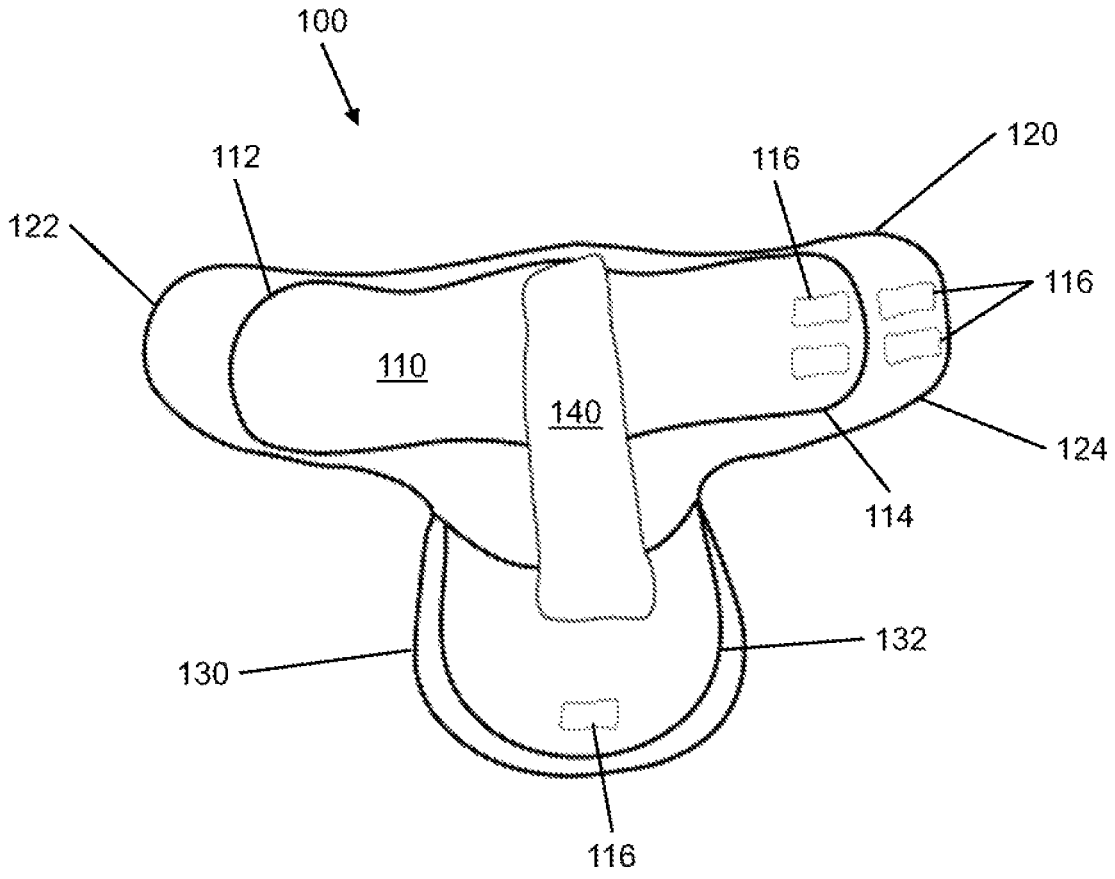
FIG. 2 shows a top, plan view of the swaddle device in an open configuration.
Figure 3:
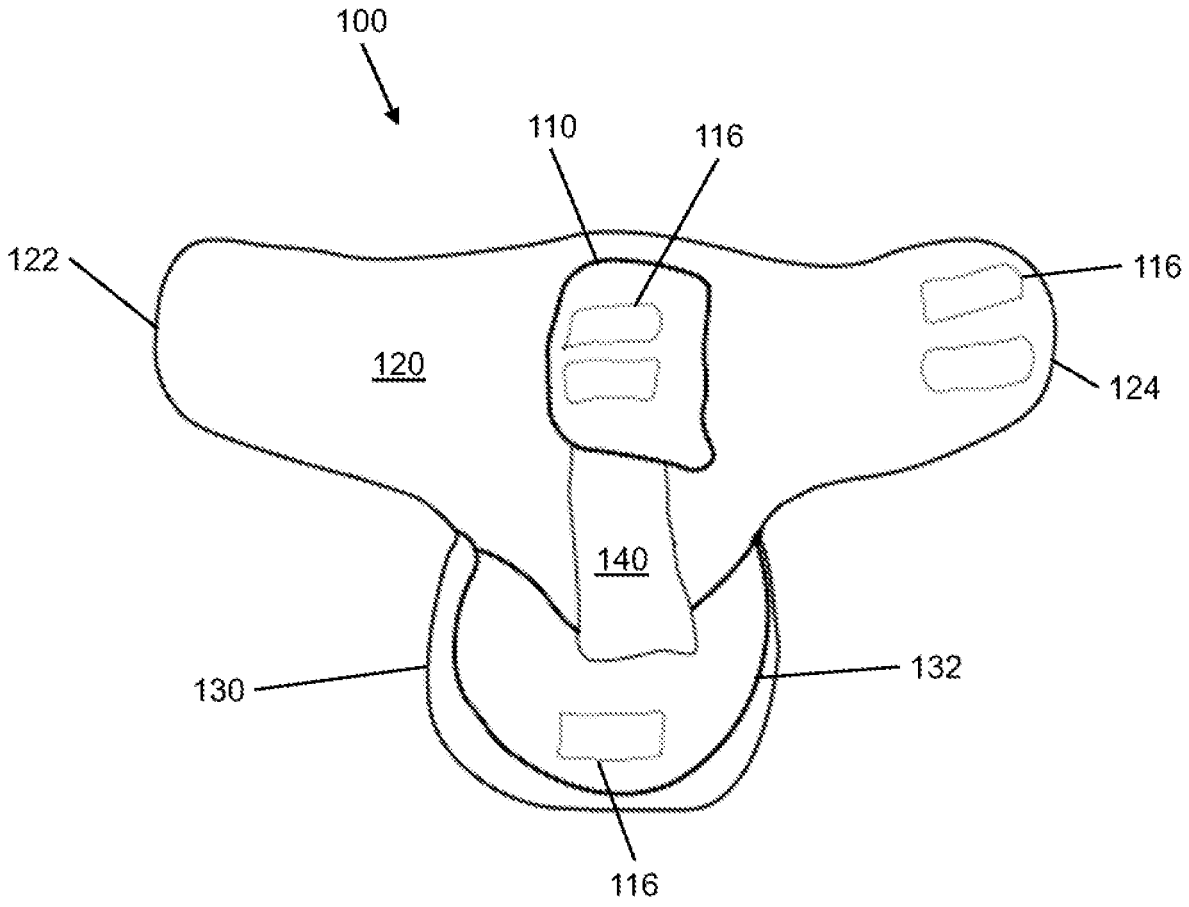
FIG. 3 shows a top, plan view of the swaddle device with an inner wrap layer in a closed position and an outer wrap layer and a lower pouch flap in open positions.
Figure 4:
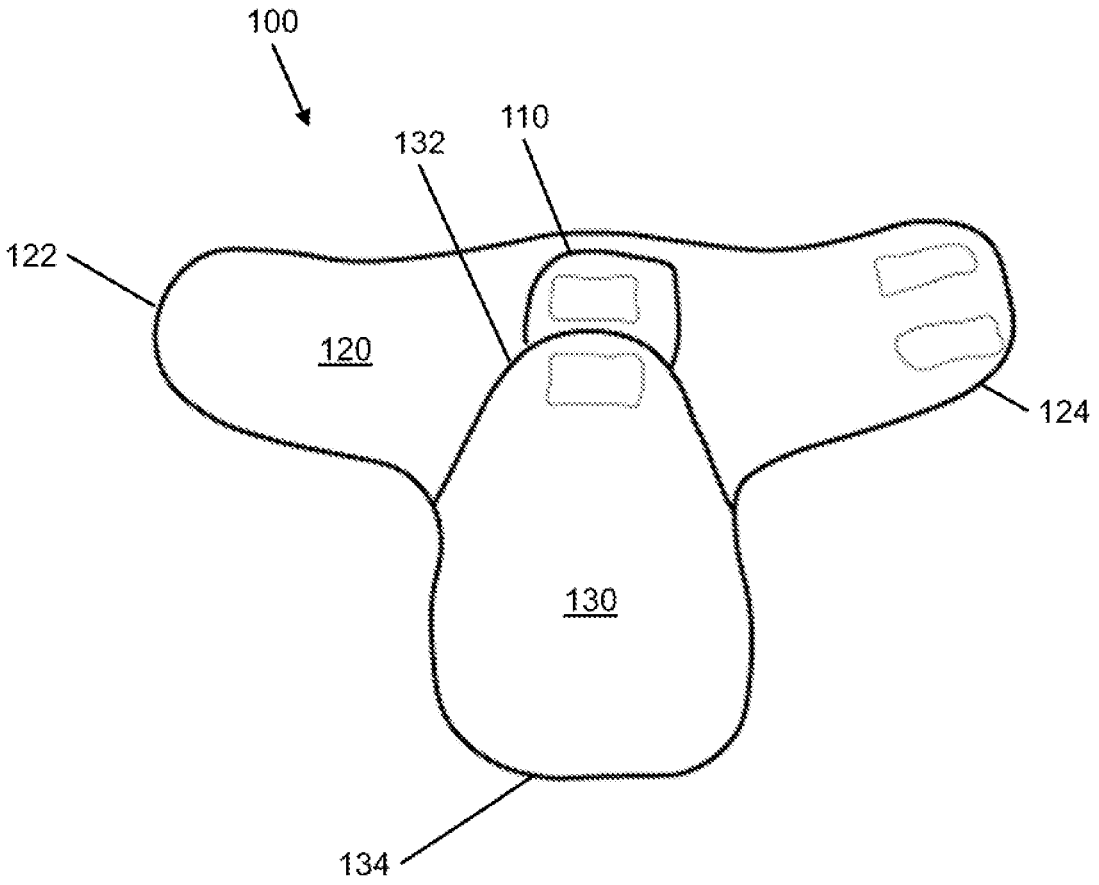
FIG. 4 shows a top, plan view of the swaddle device with the inner wrap layer and lower pouch flap in closed positions and the outer wrap layer in an open position.

As shown in FIGS. 2-4, in an exemplary embodiment, a portion of a dorsal side of the proximal end 132 of the lower pouch flap 130 is affixed to the outer wrap layer 120. Such connection between the lower pouch flap 130 and the outer wrap layer 120 may be permanent, such as but not limited to a sewn connection, or the connection may be selectively releasable, such as but not limited to a zippered connection or snap-in connection. In other embodiments, the lower pouch flap 130 is attached to the inner wrap layer 110 and/or to the internal cavity 140. In an embodiment, the proximal end 132 of the lower pouch flap 130 includes an elastic band for gathering the lower pouch flap 130 around a baby's lower torso. In another embodiment, the proximal end 132 of the lower pouch flap 130 includes a drawstring to accommodate cinching of the lower pouch flap 130 around a baby's lower torso. In additional embodiments, the distal end 134 of the lower pouch flap 130 and/or another part along the length of the lower pouch flap 130 includes one or more drawstrings to further accommodating cinching of the lower pouch flap 130 around a baby's legs and lower torso. In some embodiments, the distal end 134 of the lower pouch flap 130 is openable to allow access to a baby's legs and lower torso and enclosable via a drawstring.

In an exemplary embodiment of the present invention, the garment internal cavity 140 comprises an internal pocket configured for receiving and housing the positioning support device 200. In an exemplary embodiment, the internal pocket 140 is open or openable at one end to allow access to, insertion, removal, replacement, and/or readjustment of a positioning support device 200 within the swaddle device 2. In embodiments, an internal pocket 140 includes a selectively releasable closing mechanism, such as but not limited to hook-and-loop fasteners, zippered closure, snap-in connectors, magnetic connectors, buckles, or any other type of releasable connectors, for enclosing the internal pocket 140 around the positioning support device 200. In alternative embodiments, the internal cavity 140 of the swaddle device is fully closed, with a positioning support device 200 permanently enclosed, such as but not limited to sewn, within the garment 100. In a preferred embodiment, the internal cavity 140 is sized to closely fit around the positioning support device 200 such that movement of the positioning support device 200 within the internal cavity 140 is minimal or prevented altogether.

In an exemplary embodiment shown in FIGS. 2-3, the internal cavity 140 of the present invention is attached to portions of the inner wrap layer 110, the outer wrap layer 120, and the lower pouch flap 130. In alternative embodiments, the internal cavity 140 is connected to only the inner wrap layer 110, to only the outer wrap layer 120, to only the lower pouch flap 130, to the outer wrap layer 120 and lower pouch flap 130, to the inner wrap layer 110 and lower pouch flap 130, to the inner wrap layer 110 and outer wrap layer 120, or to any other portion(s) of a garment 100 of the present swaddle device 2. In embodiments, the swaddle device 2 includes multiple internal cavities 140 configured for housing one or more positioning support devices 200. In such embodiments, a user can selectively place a positioning support device in a particular internal pocket or utilize multiple positioning support devices in multiple internal pockets, depending on the desired positioning of a baby. In an embodiment, the swaddle device 2 includes two internal pockets, each designed to be positioned slightly off-center of the infant's spine.

In an exemplary embodiment, the positioning support device 200 of the present invention comprises a bolster, which is substantially cylindrical in shape. In other embodiments, the positioning support device 200 comprises another shape, such as a substantially triangular prism or wedge shape, a substantially rectangular prism shape, a shape conforming to a baby's body, or any other shape configured for positioning or tilting a baby's body when laying on a sleeping surface 400. In a preferred embodiment, the positioning support device 200 is made up of a material firm enough to retain a baby 300 in a desired position yet soft enough to conform comfortably to the baby's body. In alternative embodiments, the positioning support device 200 is made up of a solid, non-compressible material. In an exemplary embodiment, the positioning support device 200 is made up of a foam material. In further embodiments, the positioning support device 200 includes an outer cover stuffed with foam, cotton, down feather, expanded polystyrene (EPS) or bean bag filling, polyester fiber, soft plastic, or any other type of stuffing material. In an exemplary embodiment shown in FIGS. 7-8, the positioning support device 200 of the present invention comprises a substantially rectangular, rollable sheet of compressible material 210 configured for being rolled and gathered with elastic bands 220 to form a bolster as desired for positioning a baby. Such embodiment of a bolster 200 can be rolled tighter or looser as desired by a user of the present invention.

In an exemplary embodiment of the present invention, a positioning support device 200 is enclosed within an internal cavity 140 of the swaddle device 2. With the swaddle device garment 100 in an open configuration, a baby 300 is placed on the garment 100 in a position in relation to the positioning support device 200 as desired to unweight a portion of the baby's head 310. In a preferred embodiment, the baby 300 is positioned such that the positioning support device 200 is dorsal of the baby 300 in a substantially parallel position to the longitudinal length of the baby's body on one side off-center from the baby's spine. In alternative embodiments, one or more positioning support devices 200 can be selectively placed in one or more internal cavities 140 in desired location(s) to position the baby 300.

In an exemplary embodiment, with the baby 300 positioned in desired relation to the positioning support device 200, an inner wrap layer 110 first 112 and second fabric extensions 114 are wrapped tightly around the baby's torso such that the positioning support device 200 is retained in the desired position relative to the baby 300, and the inner wrap 110 first 112 and second extensions 114 are secured to each other, putting the inner wrap layer 110 into a closed position. In some embodiments, the inner wrap layer 110 is wrapped around the baby's torso with the baby's arms outside of the inner wrap layer 110. In other embodiments, the inner wrap layer 110 is wrapped around the baby's torso and arms.

In an exemplary embodiment, a lower pouch flap 130 is then loosely placed around the baby's legs and lower torso and secured to the inner wrap layer 110, enclosing the baby's legs and lower torso. In this embodiment, an outer wrap layer 120 first 122 and second fabric extensions 124 are then tightly wrapped around the baby 300, positioning support device 200, inner wrap layer 110, and a portion of the lower pouch flap 130 and secured to one another, resulting in a closed configuration of the swaddle device 2. In embodiments with one wrap layer, the lower pouch flap 130 can be placed around a baby's legs and lower torso first and wrap layer extensions wrapped around and secured second, or the lower pouch flap 130 can be wrapped around or otherwise secured to the outside of the wrap layer. In embodiments with additional wrap layers, the order in which the individual wrap layers and lower pouch flap are wrapped and enclosed can be varied without deviating from the present invention.

Figure 5:
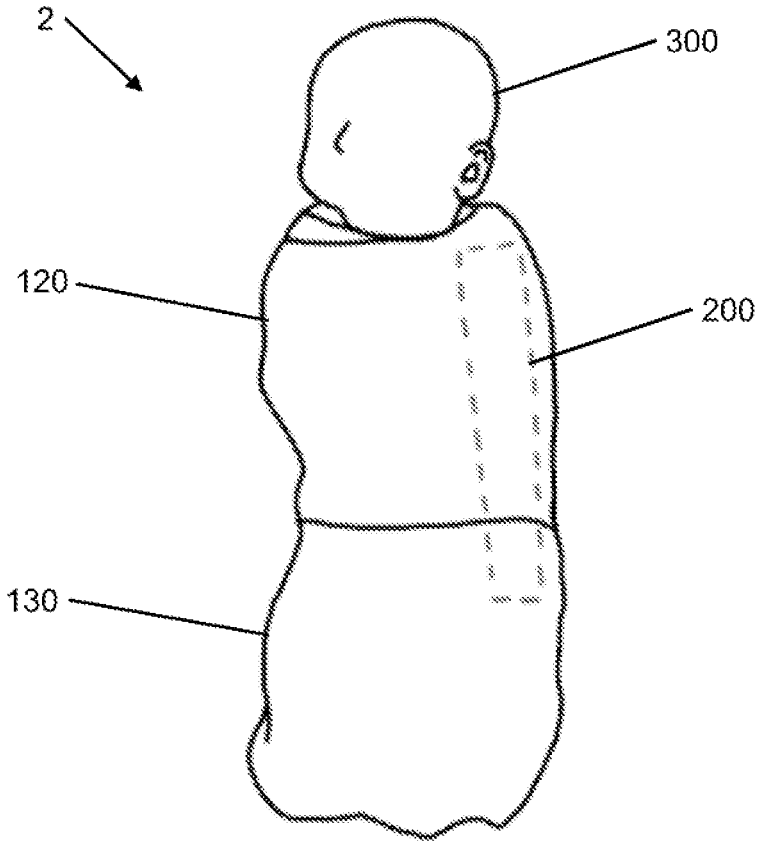
FIG. 5 shows an upper, perspective view of an embodiment of a swaddle device of the present invention wrapped around a baby.
Figure 6:
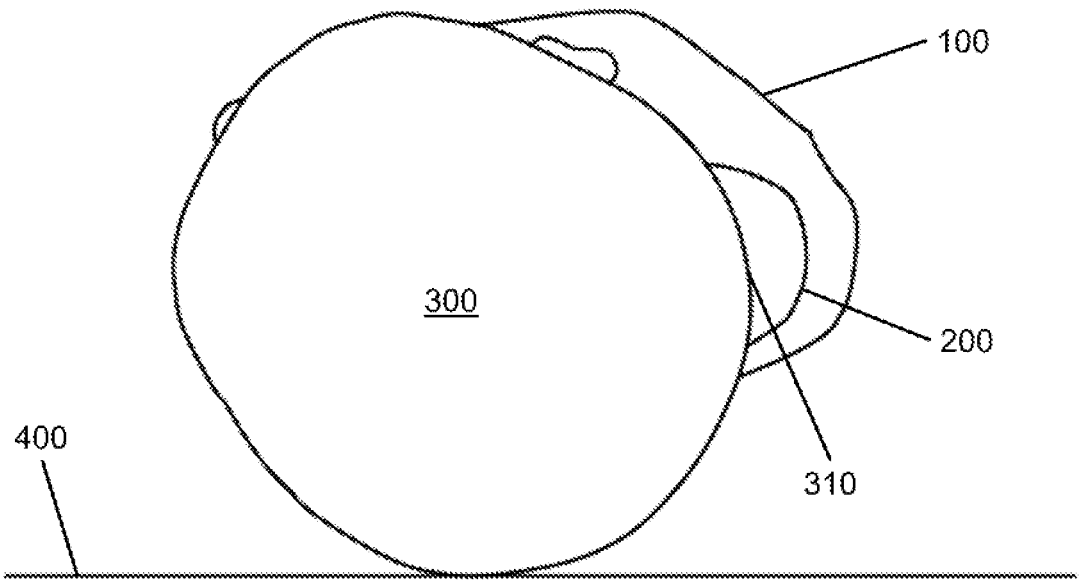
FIG. 6 shows a cranial end, elevational view of a baby wrapped in a swaddle device of the present invention.
Figure 7:
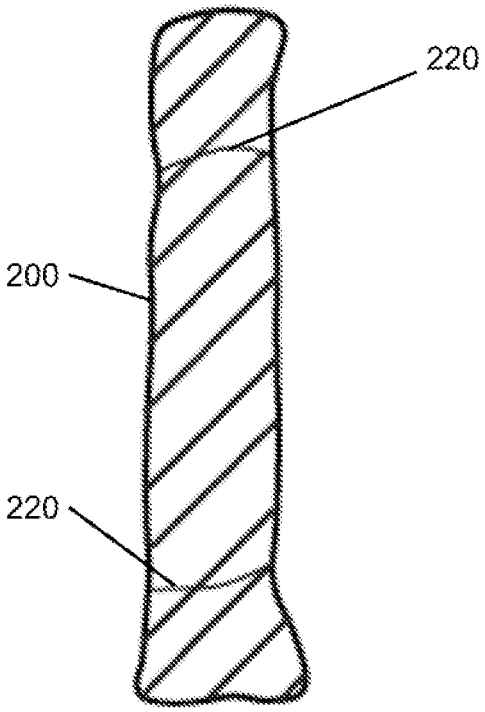
FIG. 7 shows a plan view of an embodiment of a bolster of a swaddle device of the present invention.
Figure 8:
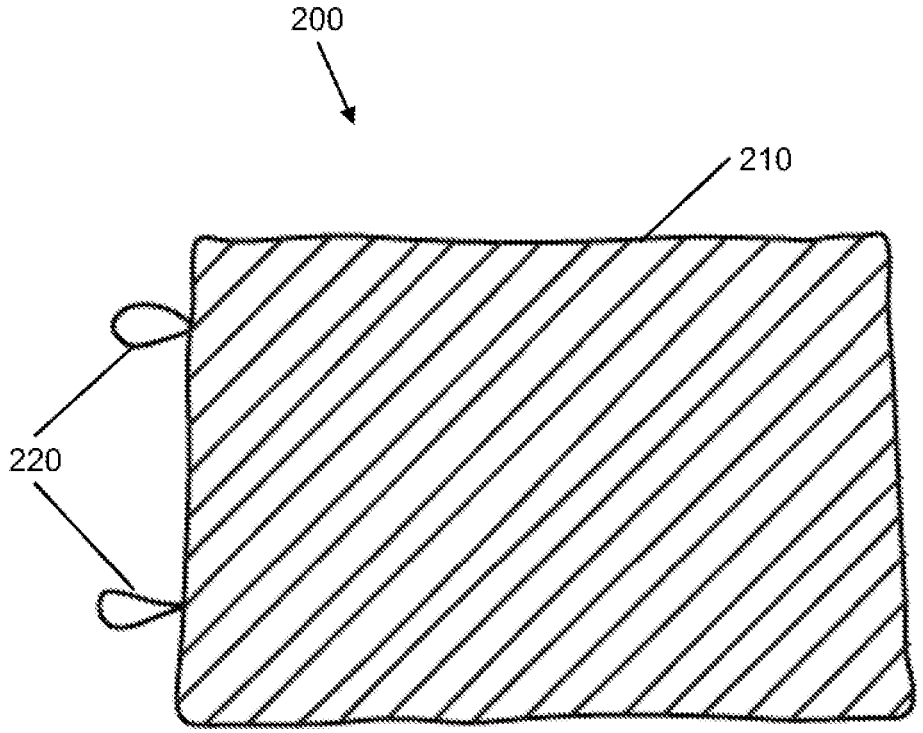
FIG. 8 shows a plan view of the bolster in an unrolled configuration.

In a preferred embodiment, in closed configuration of the swaddle device 2, the baby 300 is enclosed within the swaddle device 2 with only the baby's head and neck exposed, as shown in FIG. 5. Such configuration of the swaddle device 2 of the present invention provides calming, deep pressure to a baby's upper extremities along with secure positioning of a positioning support device 200 to slightly tilt the baby's body to keep the baby 300 from laying on a particular portion of the baby's head 310 on a sleep surface 400, as shown in FIG. 6. This accommodates unweighing of the head to counteract plagiocephaly while also providing an improved chance of restorative sleep for the baby 300.

The present swaddle device 2 can be used for prevention of skull flattening by alternating sides of the positioning support device 200 in relation to the baby 300 each day to vary the forces applied to the skull. The present swaddle device 2 can be used for correction of skull flattening by positioning the baby 300 with the positioning support device 200 on a preferred side, which angles the baby's body and head to keep pressure off the flattened side. This force, strategically applied to the fuller part of the skull, can help to reshape the skull back to a normal shape.

In another embodiment, two positioning support devices 200 can be placed within the swaddle device 2 of the present invention if a parent wants the baby 300 to sleep directly on the baby's back or needs to keep the baby 300 looking straight up. Moreover, the swaddle device 2 of the present invention can be used without any positioning support devices 200, if desired, to merely apply calming, deep pressure. In embodiments, the swaddle device 2 of the present invention is highly adaptable to meet the needs of each specific baby.

The structure of the present invention provides for ease of use, safe positioning of a baby's body rather than only the baby's head, promotion of restorative sleep, affordability, accessibility, safety with no loose parts, no restriction of the baby's movement of the head or neck, and adjustability to meet the baby's needs.

In embodiments, swaddle devices 2 of the present invention are available in different sizes to accommodate different sizes of babies (e.g., newborn size, premature baby size, micro-preemie size, standard baby sizes, etc.). In an embodiment, the swaddle garment 100 of the present invention comprises a hip friendly garment.

Certain terminology is used in the description for convenience in reference only and will not be limiting. For example, up, down, front, back, right, and left refer to the invention as orientated in the view being referred to. The words "inwardly" and "outwardly" refer to directions toward and away from, respectively, the geometric center of the aspect being described and designated parts thereof. Forwardly and rearwardly are generally in reference to the direction of travel, if appropriate. Additionally, anatomical terms are given their usual meanings. For example, proximal means closer to the trunk of the body, and distal means further from the trunk of the body. Said terminology shall include the words specifically mentioned, derivatives thereof, and words of similar meaning "Substantially" means to be more-or-less conforming to the particular dimension, range, shape, concept, or other aspect modified by the term, such that a feature or component need not conform exactly. For example, a "substantially cylindrical" object means that the object resembles a cylinder but may have one or more deviations from a true cylinder. "Comprising," "including," and "having" (and conjugations thereof) are used interchangeably to mean including but not necessarily limited to, and are open-ended terms not intended to exclude additional, unrecited elements or method steps.

Changes may be made in the above methods, devices and structures without departing from the scope hereof. Many different arrangements of the various components depicted, as well as components not shown, are possible without departing from the spirit and scope of the present invention. Embodiments of the present invention have been described with the intent to be illustrative and exemplary of the invention, rather than restrictive or limiting of the scope thereof. Alternative embodiments will become apparent to those skilled in the art that do not depart from its scope. Specific structural and functional details disclosed herein are not to be interpreted as limiting, but merely as a representative basis for teaching one of skill in the art to employ the present invention in any appropriately detailed structure. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

Having thus described the invention, what is claimed as new and desired to be secured by Letters Patent is:

1. A swaddle device comprising:

a garment comprising an inner wrap layer having first and second fabric extensions, an outer wrap layer having first and second fabric extensions and connected to said inner wrap layer, and a lower pouch directly connected to said outer wrap layer and comprising an upper flap extending proximally from said lower pouch;

a positioning support device;

an internal cavity connected to said inner and outer wrap layers and configured for housing said positioning support device, said internal cavity comprising a pocket with a selectively releasable closing mechanism and configured for receiving and housing said positioning support device;

said inner wrap layer first and second fabric extensions configured for being wrapped around a torso of a baby with said positioning support device positioned dorsal of said baby approximately parallel to a longitudinal length of said baby to a side off-center from a spine of said baby in a closed configuration, said inner wrap layer first fabric extension configured for being secured to said inner wrap layer second fabric extension in said closed configuration via a first fastener on said inner wrap layer first extension and a second fastener on said inner wrap layer second extension;

said lower pouch configured for receiving and enclosing legs and a lower torso of said baby;

said flap configured for being directly secured to said inner wrap layer in said closed configuration via a third fastener on said flap and a fourth fastener on said inner wrap layer and after said inner wrap layer first fabric extension is secured to said inner wrap layer second fabric extension;

said outer wrap layer first and second fabric extensions configured for being wrapped around said baby, said positioning support device, said inner wrap layer, and said flap in said closed configuration, said outer wrap layer first fabric extension configured for being secured to said outer wrap second fabric extension in said closed configuration via a fifth fastener on said outer wrap layer first extension and a sixth fastener on said outer wrap layer second extension.

2. The swaddle device according to claim 1, wherein: said positioning support device comprises a bolster.

3. The swaddle device according to claim 2, wherein: said bolster comprises a rollable sheet of compressible material and an elastic band configured for gathering said rollable sheet of compressible material in a substantially cylindrical shape.

4. The swaddle device according to claim 1, wherein: said positioning support device comprises a wedge.

5. A method of positioning the baby using the swaddle device according to claim 1, the method comprising steps of:

placing said baby in desired relation to said positioning support device;

wrapping said inner wrap layer first and second fabric extensions around a torso of said baby and said positioning support device;

securing said inner wrap layer first fabric extension to said inner wrap layer second fabric extension;

enclosing legs and a lower torso of said baby within said lower pouch flap;

securing said lower pouch flap to said inner wrap layer;

wrapping said outer wrap layer first and second fabric extensions around said baby, said positioning support device, said inner wrap layer, and a portion of said lower pouch flap; and securing said outer wrap layer first fabric extension to said outer wrap layer second fabric extension.

6. The method of claim 5, further comprising a step of: said positioning support device preventing said baby from laying on a portion of a head of said baby such that said portion of said head is unweighted.

7. The method of claim 5, wherein the method further comprising a step of: placing said positioning support device within said pocket.

8. The method of claim 5, wherein: said placing said baby in desired relation to said positioning support device comprises placing said baby in a position with said positioning support device dorsal of said baby approximately parallel to the longitudinal length of said baby to the side off-center from the spine of said baby.

9. The method of claim 5, wherein: said positioning support device comprises a bolster.

10. The method according to claim 9, wherein the bolster comprises a rollable sheet of compressible material, the method further comprising steps of:

rolling said rollable sheet of compressible material into a substantially cylindrical rolled sheet of compressible material;

gathering said rolled sheet of compressible material with an elastic band.

11. The method according to claim 5, wherein said lower pouch flap comprises a drawstring, the method further comprising a step of:

cinching said drawstring around said legs and lower torso of said baby.

* * * * *